US012618299B1

(12) United States Patent
Svarczkopf

(10) Patent No.: US 12,618,299 B1
(45) **Date of Patent: *May 5, 2026**

(54) DRILL CUTTINGS COMPOSITE CORE MANUFACTURING METHOD AND APPARATUS

(71) Applicant: Imperative Chemical Partners, Inc., Midland, TX (US)

(72) Inventor: Timothy C Svarczkopf, Midland, TX (US)

(73) Assignee: Imperative Chemical Partners, Inc., Midland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/233,639

(22) Filed: Jun. 10, 2025

Related U.S. Application Data

(63) Continuation of application No. 18/883,088, filed on Sep. 12, 2024, now abandoned, which is a continuation of application No. 18/077,433, filed on Dec. 8, 2022, now Pat. No. 12,116,851, which is a continuation of application No. 17/343,072, filed on Jun. 9, 2021, now Pat. No. 11,549,322, which is a continuation of application No. 17/203,003, filed on Mar. 16, 2021, now Pat. No. 11,060,364.

(60) Provisional application No. 63/021,343, filed on May 7, 2020.

(51) Int. Cl.
*E21B 21/06* (2006.01)

(52) U.S. Cl.
CPC ..... *E21B 21/065* (2013.01)

(58) Field of Classification Search
CPC ..... E21B 25/08; E21B 21/065; E21B 21/066
See application file for complete search history.

(56) References Cited

U.S. PATENT DOCUMENTS

| | | | | |
|---|---|---|---|---|
| 4,359,901 | A * | 11/1982 | Bates | E21B 49/005 73/152.59 |
| 5,571,962 | A * | 11/1996 | Georgi | E21B 21/065 175/46 |
| 11,060,364 | B1 * | 7/2021 | Svarczkopf | E21B 21/066 |
| 11,549,322 | B1 * | 1/2023 | Svarczkopf | E21B 21/065 |
| 12,116,851 | B1 * | 10/2024 | Svarczkopf | E21B 21/066 |
| 2017/0241972 | A1 * | 8/2017 | Bhamidipati | E21B 21/062 |
| 2019/0390523 | A1 * | 12/2019 | Nguyen | G01N 1/286 |
| 2020/0049002 | A1 * | 2/2020 | Nakutnyy | E21B 49/005 |

* cited by examiner

*Primary Examiner* — David Carroll
(74) *Attorney, Agent, or Firm* — Phillips Murrah PC; Martin G. Ozinga

(57) ABSTRACT

A drill cuttings composite core apparatus, system, and method that may utilize sieve shaker equipped with a solvent wash system to separate, clean, and size cuttings; a centrifugal mill equipped with a 12 tooth rotor and 1.0 mm ring sieve; a compactor mold that may be 1.5 inches in diameter and up to 6 inches long; dual piston compactor with independent air control valves; and a spacer on top of a bottom piston that may allow compacted core to be pushed up through top of mold for easy removal with no special tools or handling.

1 Claim, 6 Drawing Sheets

DRILL CUTTINGS COMPOSITE CORE MANUFACTURING METHOD AND APPARATUS

CROSS-REFERENCE TO RELATED APPLICATIONS

This present application is a continuation of U.S. patent application Ser. No. 18/883,088, filed on Sep. 12, 2024, currently pending, which is a continuation of U.S. patent application Ser. No. 18/077,433, filed on Dec. 8, 2022, now U.S. Pat. No. 12,116,851, issued on Oct. 15, 2024, which is a continuation of U.S. patent application Ser. No. 17/343,072, filed on Jun. 9, 2021, now U.S. Pat. No. 11,549,322, issued on Jan. 10, 2023, which is a continuation of U.S. patent application Ser. No. 17/203,003, filed on Mar. 16, 2021, now U.S. Pat. No. 11,060,364, issued on Jul. 13, 2021, in which priority is claimed from U.S. Provisional Patent Application Ser. No. 63/021,343 filed on May 7, 2020. Each of the applications listed above is expressly incorporated herein by reference in their entirety.

BACKGROUND OF THE INVENTION

1. Field of the Invention

In general, the present invention relates to oil and gas well fracturing. More particularly, the present invention provides an apparatus, system, and method to provide statistically significant and reliable population of core samples for running geochemistry experiments to measure the interaction of hydraulic fracturing fluids on rocks from the varied geochemical thermal maturity windows by using cuttings from the drilling process of the well and or wells.

2. Description of the Prior Art

It is desirable while performing drilling operations to understand the geophysical properties of the earth to be drilled. A core sample is a cylindrical section of a naturally occurring portion of the earth. Most core samples are obtained by drilling with special drills into the substance, for example sediment or rock, with a hollow steel tube called a core drill. Doing so requires setting up a drilling rig to obtain a core sample and drilling to the depth where the well may be located.

It costs approximately $1.5 MM to collect a single core sample utilizing traditional techniques. The net result is that it is too expensive and not logistically possible to get a statistically significant population of core samples for running geochemistry experiments to measure the interaction of hydraulic fracturing fluids on rocks from the varied geochemical thermal maturity windows where unconventional shale deposits are located.

In order to develop a hydraulic fracturing fluid with the intent of increasing well productivity via an imbibition displacement production mechanism, hundreds to thousands of possible fluid combinations need to be tested on core from each thermal maturity window. Conventional oil reservoir sandstone cores have porosities ranging from 10% to 20% and permeability ranging from 500 millidarcies to 2.5 darcies. These commercially available cores, such as but not limited to Berea Sandstone for example, are robust enough that single core samples can be cleaned and reused for fluid development studies.

Reusing single core for fluid studies is not possible for unconventional oil reservoir shale cores as porosities range from only 2% to 12% and permeabilities range from 100 nanodarcies to 10 millidarcies. The smaller pore size and unstable clay content make it impossible to reuse native core from unconventional wells. Also, fluid studies on native core are of limited value with regard to unconventional shale because native core contains decompression fractures that occur in the process of bringing the samples to surface.

Furthermore, native core plugs do not represent a statistically relevant population of data for the well bore geochemistry compared to composite core. For example, calcite filled fractures are commonly observed in native core plugs.

Approximately 50% of native core plugs have natural fractures, which can skew results. It is also likely that pressure relief expansion in going from formation pressure to atmospheric pressure causes the cores to crack from decompression. And still, it also takes much longer to run the experiments on native core plugs. The effective permeability loss is much greater for native core plugs than composite core plugs.

The Fann LSM 2100 Linear Swell Meter compactor represents the only commercially available prior art for making any type of core from drill cuttings. The LSM 2100 compactor has the following flaws, which result in LSM 2100 compactor making core plugs that are unacceptable for industry accepted core flood apparatus, and which cause the LSM 2100 compactor generated core plugs to have unacceptable reproducibility errors for the linear swell experiment or core flood experiments.

There are prior art devices such as the LSM 2100 compactor that generate a core. However, they are not sized correctly for core flood experiments. The LSM 2100 generated core apparatus utilizes 20 grams of cuttings to produce a core that is 1⅛" diameter by ⅝" long. Core holders for industry accepted core flood experiments utilize core that is either 1" in diameter or 1.5" in diameter. Industry accepted core flood apparatus require core that is a minimum of 1" long and sometimes up to 6" long to enable effective study of fluid geochemical interactions with the rock.

Still further, the LSM 2100 compactor utilizes a single piston that exhibits force on the cuttings in a downward motion only. This single direction of force causes air that is trapped in between the cuttings' particles to flow in a single direction toward the bottom of the core mold with no means of escape except up the sides of the core mold and in the opposite direction of the mechanical force. Finer particles get swept with this compressed air that is being trafficked within the core being manufactured in a randomized manner. Both air and fine particles wind up being randomly distributed throughout the LSM 2100 compactor generated core resulting in failure to provide reproducible porosity, permeability, and mineral distribution for each core made.

The prior art attempts to compensate for the flawed LSM 2100 apparatus design in the methods deployed. Cuttings utilized for core manufacture in the LSM 2100 are held at a constant humidity of 29.5%. This does not mimic the actual geologic setting at all. The unconventional shale geologic setting conditions can best be described as completely desiccated, completely brine water saturated, completely oil saturated, or all points in between. Further, the LSM 2100 compactor method requires adjusting the cuttings moisture content to precisely 5% with deionized water. This further worsens the ability of the LSM 2100 compactor capability to make reproducible cores as it is impossible to evenly distribute this 5% moisture throughout the cuttings utilizing simple spatulas and kneading. Use of deionized water with cuttings samples that contain swellable clays ruins the geochemical integrity and pore structure of the core. This makes reproducibility impossible in any type of rock fluid interaction study. The LSM 2100 compactor method requires compacting the cuttings at 10,000 PSI for 1.5 hours. The compacting time is excessive resulting in tighter pore structure and lower permeability than the actual geologic setting. It has a pragmatic effect of being able to make very few cores whereas hundreds to thousands of cores are necessary for developing hydraulic fracturing fluids for a particular geologic setting.

Furthermore, removal of the produced core from the LSM 2100 apparatus requires the use of an extraction tool and manual handling of the core holder and core to remove the core from the apparatus. This can damage the core resulting in further reliability issues.

It is therefore desirable to get a statistically significant and reliable population of core samples for running geochemistry experiments to measure the interaction of hydraulic fracturing fluids on rocks from the varied geochemical thermal maturity windows especially where unconventional shale deposits are located. The above discussed limitations in the prior art are not exhaustive. The current invention provides an inexpensive, time saving, more reliable apparatus and method of using the same where the prior art fails.

SUMMARY OF THE INVENTION

In view of the foregoing disadvantages inherent in the known types of core retrieval and core fabrications now present in the prior art, the present invention provides a new and improved core sample utilizing cuttings from a well and or wells. As such, the general purpose of the present invention, which will be described subsequently in greater detail, is to provide a new and improved drill cuttings composite core apparatus, system, and method of using the same, which has all the advantages of the prior art devices and none of the disadvantages.

To attain this, the present invention essentially comprises a drill cuttings composite core apparatus, system, and method that may utilize a sieve shaker equipped with a solvent wash system to separate, clean, and size cuttings; a centrifugal mill equipped with a 12 tooth rotor and 1.0 mm ring sieve; a compactor mold that may be 1.5" in diameter and up to 6" long; dual piston compactor with independent air control valves; a spacer on top of the bottom piston that may allow the compacted core to be pushed up through the top of the mold for easy removal with no special tools or handling; and so forth.

There has thus been outlined, rather broadly, the more important features of the invention in order that the detailed description thereof that follows may be better understood and in order that the present contribution to the art may be better appreciated. There are, of course, additional features of the invention that will be described hereinafter, and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved drill cuttings composite core apparatus, system, and method of using the same, which may provide more accurate representations of geophysical properties associated with well stimulation.

It is a further object of the present invention to provide a new and improved drill cuttings composite core apparatus, system, and method of using, which may be easily and efficiently manufactured and marketed.

An even further object of the present invention is to provide a new and improved drill cuttings composite core apparatus, system, and method of using same, which is susceptible to a low cost of manufacture with regard to both materials and labor, and which accordingly is then susceptible to low prices of sale to the consuming industry, thereby making such value economically available to those in the field.

Still another object of the present invention is to provide a new and improved drill cuttings composite core apparatus, system, and method of using, which provides all of the advantages of the prior art, while simultaneously overcoming some of the disadvantages normally associated therewith.

Another object of the present invention is to provide a new and improved drill cuttings composite core apparatus, system, and method of using that provides for rock fluid interaction testing that is far more reliable than using native cores.

Yet another object of the present invention is to provide a new and improved drill cuttings composite core apparatus, system, and method of using that provides reproducible manufacture of composite core from drill cuttings with regard to porosity, permeability, and mineral distribution perspectives.

An even further object of the present invention is to provide a new and improved drill cuttings composite core apparatus, system, and method of using the same that represents a statistically relevant population of data for the well bore geochemistry compared to native core plugs that do not do so.

Still another object of the present invention is to provide a new and improved drill cuttings composite core apparatus, system, and method of using that provides a shorter run time for experiments than native core plugs.

Yet still another object of the present invention is to provide a new and improved drill cuttings composite core apparatus, system, and method of using that provides a better core compared to native core plugs wherein approximately 50% of the native core plugs had natural fractures that are likely formation pressure relief expansion in going from formation pressure to atmospheric pressure, thereby causing the cores to crack from decompression.

Another object of the present invention is to provide a new and improved drill cuttings composite core apparatus, system, and method of using the same wherein the effective permeability loss is less in the composite core plugs than for native core plugs.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices wherein.

DETAILED DESCRIPTION OF THE PREFERRED EMBODIMENTS

Figure 1:
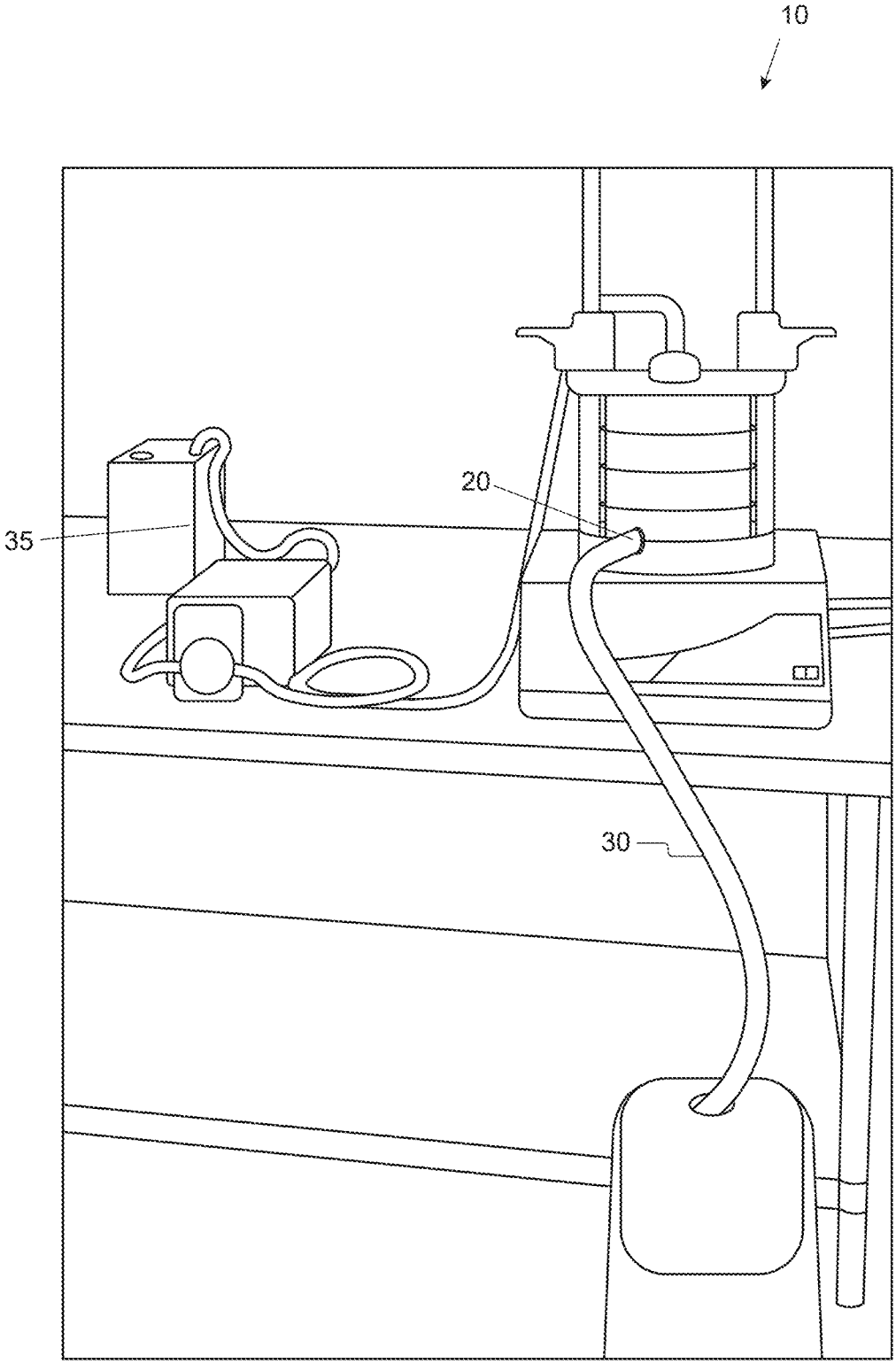
FIG. 1 is a general illustration of a preferred embodiment of the invention.

Referring to the illustrations, drawings, and pictures, reference character 10 generally designates a new and improved drill cuttings composite core apparatus, system, and method of using same in accordance with the present invention. Invention 10 is generally used in conjunction with well fracturing for the retrieval of hydrocarbons below the surface. It is contemplated that invention 10 may be utilized for other well applications other than hydrocarbon retrieval such as but not limited to water retrieval.

Referring to the illustrations and FIG. 1 in particular, invention 10 may utilize a sieve shaker 20 equipped with a solvent wash system 30 to separate, clean, and size cuttings so that the cuttings are suitable for compaction into an artificial core. The preferred embodiment utilizes a sieve shaker P1 setting, amplitude of 2.5 and a time of 5 minutes for cleaning. For drill cuttings where oil-based mud was utilized during the drilling process, the preferred embodiment of the invention utilizes xylene as the primary wash and isopropyl alcohol as a secondary wash. The solvent system and mechanical apparatus allow for the least penetration of fluid into the cuttings making the cuttings most suitable for creating composite core.

The invention preferred embodiment utilizes a sieve or sieving stack 35 that targets separation of coarser cuttings material as coarser materials are least contaminated by the drilling fluids, which adversely affects suitability of the cuttings for making a composite core. A preferred embodiment uses sieve stack 35 of size numbers 12, 14, 18, and 40 sieves. In a preferred embodiment, a mass ratio of 25% number 40 sieved cuttings, 25% number 18 sieved cuttings, 25% number 14 sieved cuttings, and 25% number 12 sieved cuttings are collected and recombined for making composite core. This may ensure that an adequate amount of natural binder present in the rock is available for compacting into core. The cleaned, sieved, recombined by mass ratio cuttings may be placed in an oven to dry overnight.

Figure 2:
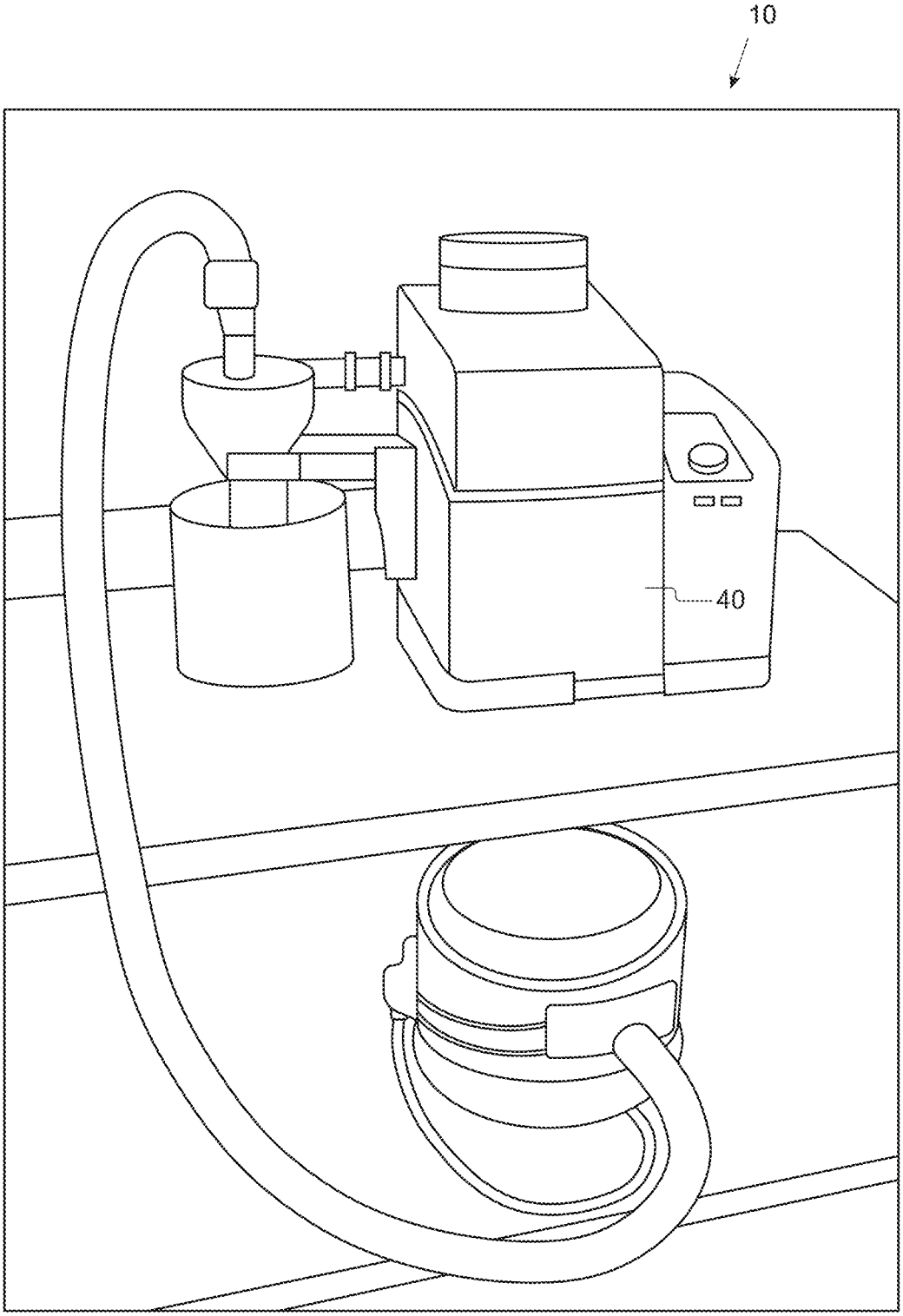
FIG. 2 is a general illustration of a preferred embodiment of the invention.

Referring to the illustrations and FIG. 2 in particular, invention 10 may have a preferred embodiment utilizing a centrifugal mill 40 equipped with a 12 tooth rotor and 1.0 mm ring sieve. The cleaned, dried, sieved, recombined by mass ratio cuttings are fed into the centrifugal mill 40. In a preferred embodiment, the centrifugal mill 40 is set to operate at 18,000 rpm. After milling, the cleaned, dried, sieved, recombined by mass ratio cuttings are now adequately prepared for compaction into composite core. Methods and apparatus described above explain how sample preparation flaws in the prior art have been solved by the invention.

Figure 3:
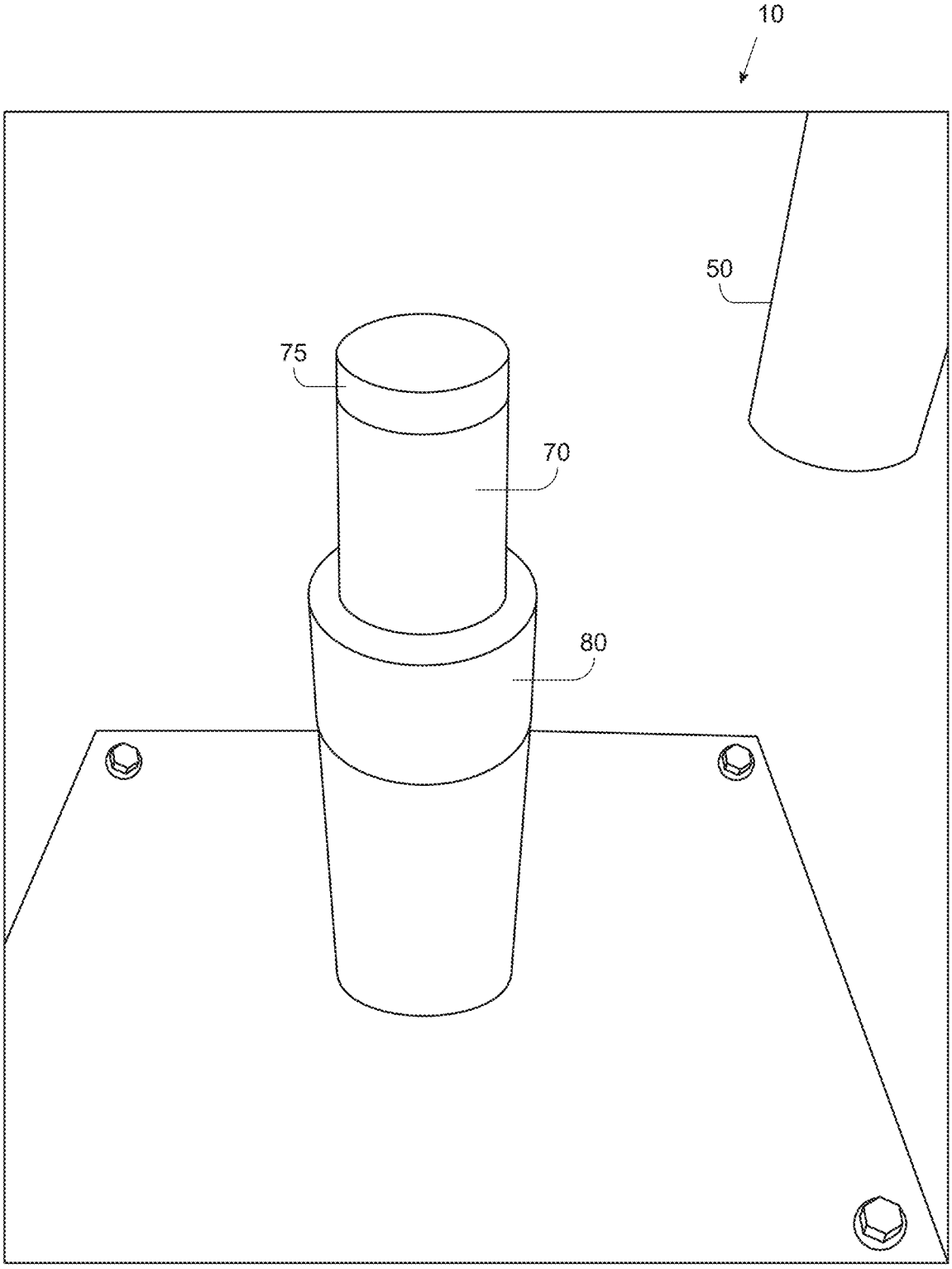
FIG. 3 is a general illustration of a preferred embodiment of the invention.

Referring to the illustrations and FIG. 3 in particular, invention 10 may have a preferred embodiment, which utilizes a compactor mold 50 that may be 1.5 inches in diameter and up to 6 inches long. This solves the flaw in prior art that does not produce core that is suitable industry accepted core flood apparatus. For example, 57 grams of cuttings prepared by the preferred invention embodiment results in a composite core that is 1.5 inches in diameter and 1 inch long. 171 grams of cuttings prepared by the preferred invention embodiment results in a composite core that is 1.5 inches in diameter and 3 inches long.

Figure 4:
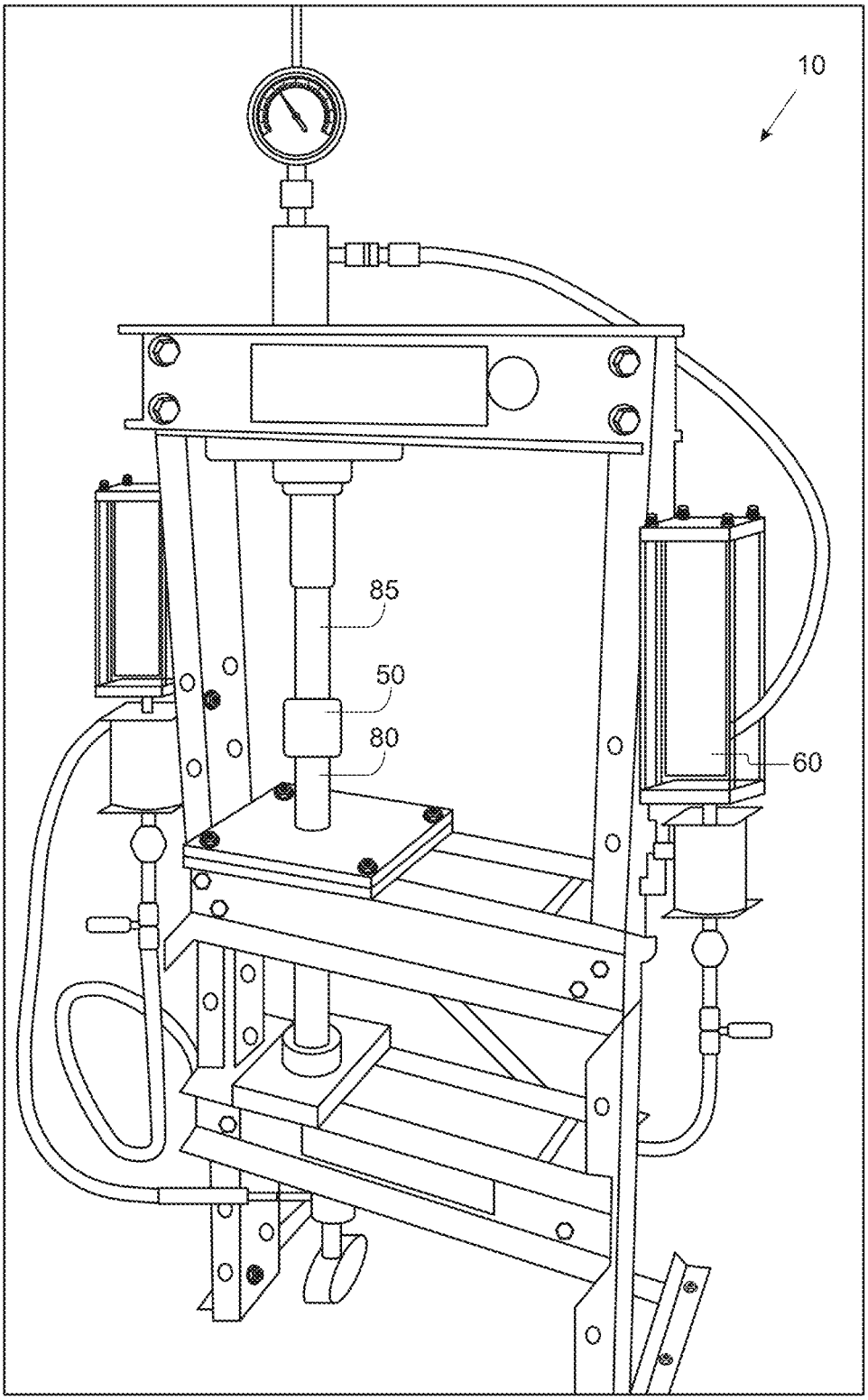
FIG. 4 is a general illustration of a preferred embodiment of the invention.

Referring to the illustrations and FIG. 4 in particular, invention 10 may utilize a dual piston compactor 60 having a bottom piston 80 and a top piston 85 with independent air control valves that exerts downward and or upward force or pressure from both top and bottom on the cuttings during compaction. This dual direction of force (which may be controlled by PLC) causes air that is trapped in between the cuttings' particles to flow in a controlled manner causing the air and any fine particles swept with the compressed air to be compacted exactly in the same manner and at the same location in each composite core manufactured. The preferred dual piston compactor 60 force embodiment solves the random distribution of air and fine particles flaw present in prior art. This in turn allows the invention 10 to create composite core with reproducible porosity, permeability, and mineral distribution that prior art is not capable of providing.

Invention 10 dual force piston compactor 60 may utilize a preferred embodiment compacting time of 15 seconds at 10,000 PSI. Thus, the invention 10 allows for hundreds to thousands of composite cores to be manufactured for experimentation, which solves the hour and half per core limitation of prior art. The invention 10 may have a preferred embodiment that can allow core to be manufactured that is much higher in porosity and permeability while maintaining physical integrity, which is an advantage over prior art limitations.

Figure 5:
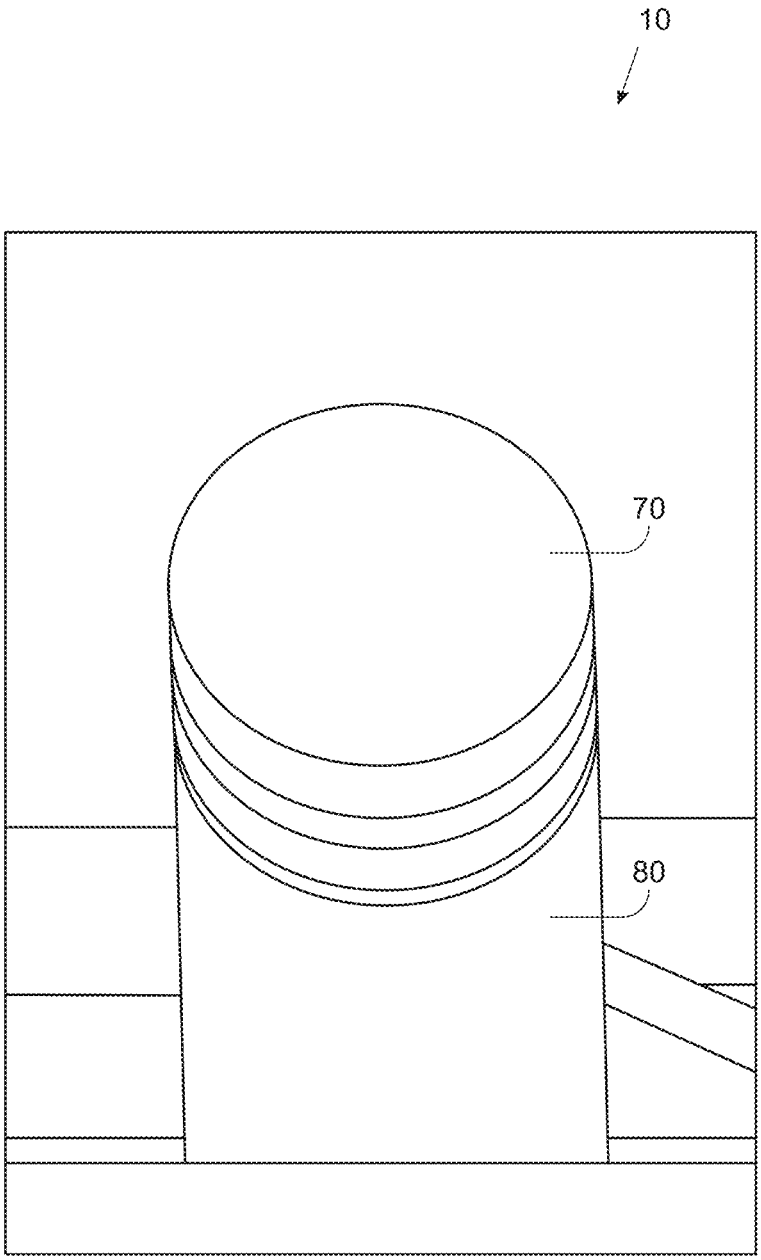
FIG. 5 is a general illustration of a preferred embodiment of the invention.
Figure 6:
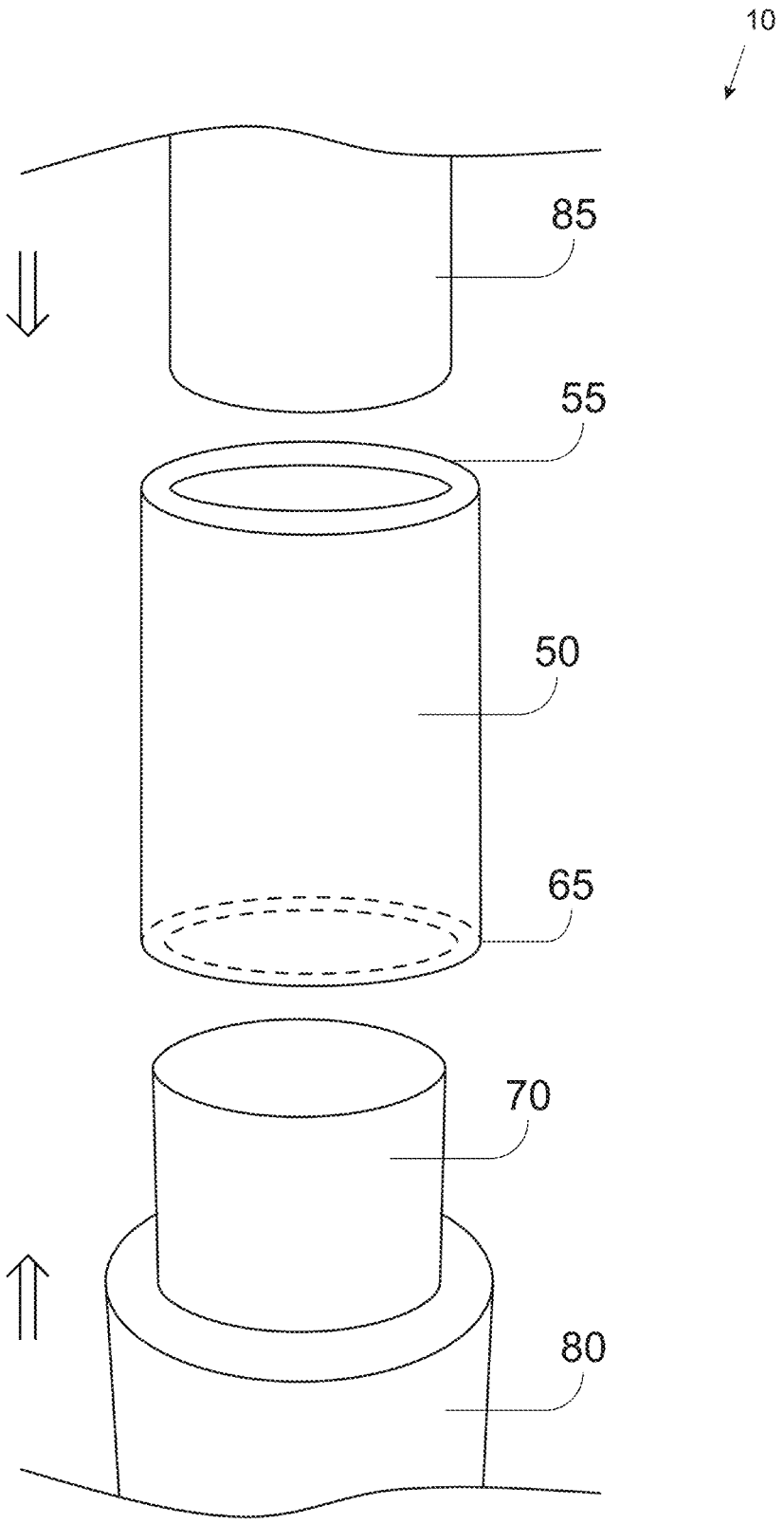
FIG. 6 is a general illustration of a preferred embodiment of the invention.

Referring to the illustrations and FIGS. 3, 5 and 6 in particular, invention 10 utilizes a spacer 70 on top of a bottom piston 80. This allows a compacted core 75 to be pushed up through a top opening 55 of the mold 50 for easy removal with no special tools or handling, which is a limitation of prior art. It is contemplated to place mold 50 bottom opening 65 on bottom piston 80 before loading with the cuttings.

Invention 10 contemplates providing a reproducible manufacture of composite core from drill cuttings with regard to porosity, permeability, and mineral distribution perspectives; high speed and volume manufacturing of composite core suitable for use in industry accepted core flood experimental apparatus; control of composite core porosity and permeability based on compacting time and compacting force; manufacturing of composite core from drill cuttings without use of any artificial binder that would otherwise contaminate the rock geochemistry; a composite core that can also be made with cuttings saturated to varied concentrations with native brine pore water; and a composite core that can also be made with cuttings saturated to varied concentrations with native oil.

Invention 10 may be a method of creating a drill cuttings composite artificial core sample comprising the steps: drilling a well; collecting drill cuttings from said drilling; utilizing a sieve shaker with a solvent wash system to separate said drill cuttings to a uniform size of said drill cuttings; washing said uniform cuttings of said drill cuttings; utilizing a sieving stack to separate coarser cutting from said uniform cuttings creating a composite; utilizing a centrifugal mill to recombine said composite forming a composite core material; drying said composite core material; placing said composite core material in a mold having a top and bottom; placing said mold in a piston compactor having a top piston for applying downward pressure on said composite core material and bottom piston for applying upward pressure to said composite core material; and forming said drill cuttings composite artificial core sample by said applying downward pressure on said composite core material and said applying upward pressure to said composite core material.

Changes may be made in the combinations, operations, and arrangements of the various parts and elements described herein without departing from the spirit and scope of the invention. Furthermore, names, titles, headings, and general division of the aforementioned are provided for convenience and should, therefore, not be considered limiting.

I claim:

1. A method of creating a drill cuttings composite artificial core sample comprising the steps:

collecting drill cuttings;

utilizing a sieve shaker to separate said drill cuttings to a uniform size of said drill cuttings;

utilizing a sieving stack to separate coarser cutting from said uniform cuttings creating a composite;

utilizing a centrifugal mill to recombine said composite forming a composite core material;

placing said composite core material in a mold having a top and bottom;

placing said mold in a piston compactor having a top piston for applying downward pressure on said composite core material and bottom piston for applying upward pressure to said composite core material;

forming said drill cuttings composite artificial core sample by said applying downward pressure on said composite core material and said applying upward pressure to said composite core material; and removing said mold from said piston compactor.

* * * * *